US008347508B2

(12) United States Patent
Shimizu et al.

(10) Patent No.: US 8,347,508 B2
(45) Date of Patent: Jan. 8, 2013

(54) ELECTRIC SHAVER

(75) Inventors: Hiroaki Shimizu, Hikone (JP); Hiroshi Shigeta, Fujiidera (JP); Shin Hosokawa, Hikone (JP); Jyuzaemon Iwasaki, Nagahama (JP)

(73) Assignee: Panasonic Corporation, Osaka (JP)

( * ) Notice: Subject to any disclaimer, the term of this patent is extended or adjusted under 35 U.S.C. 154(b) by 407 days.

(21) Appl. No.: 12/644,696

(22) Filed: Dec. 22, 2009

(65) Prior Publication Data

US 2010/0175263 A1 Jul. 15, 2010

(30) Foreign Application Priority Data

Jan. 15, 2009 (JP) ..... 2009-006274

(51) Int. Cl.
*B26B 19/28* (2006.01)
*B26B 21/52* (2006.01)

(52) U.S. Cl. ..... 30/45; 30/527

(58) Field of Classification Search ..... 30/45, 41.9, 30/43–43.92, 42, 44
See application file for complete search history.

(56) References Cited

U.S. PATENT DOCUMENTS 3,321,831 A * 5/1967 Harr et al. ..... 30/45
3,327,387 A * 6/1967 Harr et al. ..... 30/34.2
3,389,323 A * 6/1968 Jepson et al. ..... 320/115
3,521,093 A * 7/1970 Harms ..... 310/19
3,780,434 A * 12/1973 de Boer et al. ..... 30/34.1
2002/0059729 A1* 5/2002 Ikuta et al. ..... 30/43.91
2004/0128834 A1* 7/2004 Royle ..... 30/43.92
2005/0138821 A1* 6/2005 Tsushio et al. ..... 30/527
2007/0022607 A1 2/2007 Takeuchi et al.
2008/0282576 A1 11/2008 Ueda et al.
2008/0307653 A1 12/2008 Wattam
2009/0241343 A1* 10/2009 Yamasaki et al. ..... 30/43.92
2010/0175260 A1* 7/2010 Shigeta et al. ..... 30/34.1
2010/0175262 A1* 7/2010 Shigeta et al. ..... 30/43

(Continued)

FOREIGN PATENT DOCUMENTS

EP 1405701 4/2004

(Continued)

OTHER PUBLICATIONS

E.P.O. Office action, mail date is Aug. 24, 2011.

(Continued)

*Primary Examiner* — Sean Michalski
(74) *Attorney, Agent, or Firm* — Greenblum & Bernstein P.L.C.

(57) ABSTRACT

An electric shaver includes a rod-shaped body part, a head part, and a link mechanism. The head part projects from one end portion, in a longitudinal direction, of the body part and is swingably attached to the body part with a support base between the body part and the head part. The head part includes a shaving portion and a drive mechanism. The shaving portion is formed to be elongated in a direction orthogonal to a projecting direction of the head part and has paired blades configured to operate relative to each other. The drive mechanism is configured to drive at least one of the paired blades. The link mechanism includes two link arms each connected to the support base and the head part respectively at connecting axes parallel to a longitudinal direction of the shaving portion. The link mechanism is configured to support the head part on the support base swingably. The two link arms are disposed asymmetrically with respect to a straight line passing on a center of gravity of the head part and extending parallel with the projecting direction of the head part, when viewed in the longitudinal direction of the shaving portion.

7 Claims, 10 Drawing Sheets

U.S. PATENT DOCUMENTS

| | | | | |
|---|---|---|---|---|
| 2010/0175263 | A1* | 7/2010 | Shimizu et al. | 30/43.92 |
| 2010/0175264 | A1* | 7/2010 | Shimizu et al. | 30/45 |
| 2010/0180448 | A1* | 7/2010 | Sato et al. | 30/43.92 |

FOREIGN PATENT DOCUMENTS

| | | |
|---|---|---|
| EP | 1935585 | 6/2008 |
| JP | 6-343776 | 12/1994 |
| JP | 2002-315978 | 10/2002 |
| JP | 2005-192615 | 7/2005 |
| JP | 2006-042897 | 2/2006 |
| JP | 2006-42897 | 2/2006 |

OTHER PUBLICATIONS

Office Action from Russia, mail date is Oct. 2010.

U.S. Appl. No. 12/644,557 to Shigeta et al., filed Dec. 22, 2009.

U.S. Appl. No. 12/649,440 to Shigeta et al., filed Dec. 30, 2009.

U.S. Appl. No. 12/649,447 to Shimizu et al., filed Dec. 30, 2009.

Japan Office action, dated Sep. 13, 2011 along with an English translation thereof.

* cited by examiner

ELECTRIC SHAVER

CROSS REFERENCE TO RELATED APPLICATION

This application is based upon and claims the benefit of priority from the prior Japanese Patent Application No. 2009-006274, filed on Jan. 15, 2009, the entire contents of which are incorporated herein by reference.

BACKGROUND OF THE INVENTION

1. Field of the Invention

The present invention relates to an electric shaver.

2. Description of the Related Art

Japanese Patent Application Laid-Open Publication No. Hei 6-343776 discloses an electric shaver in which a head part having elongated shaving portions is attached to a tip portion of a substantially rod-shaped body part swingably about two swing axes orthogonal to each other.

SUMMARY OF THE INVENTION

To shave one's cheeks, for example, an electric shaver of this kind is used in a horizontal position. When the electric shaver is in such horizontal position, the gravity acting on the head part allows the head part to swing downward easily, but not to swing upward easily, in some cases. Meanwhile, a head part is provided with a biasing mechanism, such as a coil spring, to generate a reactive force against swing and thus to bring the head part back to its original position. However, depending on how the biasing mechanism is attached, the reactive force against swing sometimes varies among the swing directions (i.e., clockwise or counterclockwise) in swing about even one of the swing axes. In other words, in this conventional electric shaver, the swing characteristics of the head part, that is, the following performance of the head part exerted on an uneven shaving area varies depending on in which direction the electric shaver is moved along the shaving area. Thus, there is a possibility that the electric shaver cannot fully demonstrate its shaving performance. In addition, a swing mechanism to improve the following performance of the head part is desired to be compact.

An object of the present invention is thus to provide a more compact electric shaver including a head part capable of exerting an improved following performance on an uneven shaving area.

An aspect of the present invention is an electric shaver comprising: a rod-shaped body part; a head part projecting from one end portion, in a longitudinal direction, of the body part and swingably attached to the body part with a support base between the body part and the head part, the head part including a shaving portion and a drive mechanism, the shaving portion formed to be elongated in a direction orthogonal to a projecting direction of the head part and having paired blades configured to operate relative to each other, the drive mechanism configured to drive at least one of the paired blades; and a link mechanism including two link arms each connected to the support base and the head part respectively at connecting axes parallel to a longitudinal direction of the shaving portion, the link mechanism configured to support the head part on the support base swingably, wherein the two link arms are disposed asymmetrically with respect to a straight line passing on a center of gravity of the head part and extending parallel with the projecting direction of the head part, when viewed in the longitudinal direction of the shaving portion.

According to the aspect, the head part is configured to be swingably supported on the support base with the link mechanism including the two link arms therebetween. Thus, with a relatively simple configuration only requiring the asymmetrical disposition of the link arms, it is possible to set the position of the swing axis to a more appropriate position in the projecting direction of the head part and also in a direction orthogonal to the longitudinal direction of the shaving portion, in a relatively simple manner. This makes it easier to set a more appropriate moment arm about the swing axis for an input from a shaving area to the head part (a contact surface thereof), and thus makes it easier to set more appropriate swing load torque about the swing axis. Consequently, an improved following performance of the head part on the shaving area can be exerted more easily.

Lengths of the two link arms may be different from each other.

According to this configuration, the lengths of the two link arms are made different from each other, thereby making it easier to set more appropriate swing load torque about the swing axis.

Lengths of the two link arms may be identical to each other.

The support base may be formed integrally with the body part.

The support base may be formed separately from the body part.

The electric shaver may further comprise another link mechanism configured to support the support base on the body part swingably about an axis orthogonal to the projecting direction of the head part and the connecting axes.

The connecting axes for connection of the two link arms to the support base may be located asymmetrically with respect to the straight line, when viewed in the longitudinal direction of the shaving portion.

According to this configuration, the connecting axes for connection of the two link arms to the support base are located asymmetrically with respect to the straight line passing on the center of gravity of the head part and extending parallel with the projecting direction of the head part, when viewed in the longitudinal direction of the shaving portion. This makes it easier to set more appropriate swing load torque about the swing axis.

The connecting axes for connection of the two link arms to the head part maybe located asymmetrically with respect to the straight line, when viewed in the longitudinal direction of the shaving portion.

According to this configuration, the connecting axes for connection of the two link arms to the head part are located asymmetrically with respect to the straight line passing on the center of gravity of the head part and extending parallel with the projecting direction of the head part, when viewed in the longitudinal direction of the shaving portion. This makes it easier to set more appropriate swing load torque about the swing axis.

The connecting axes for connection of the two link arms to the support base may be displaced from each other in a direction of the straight line.

The connecting axes for connection of the two link arms to the head part maybe displaced from each other in a direction of the straight line.

DETAILED DESCRIPTION OF THE EMBODIMENT

Figure 1:
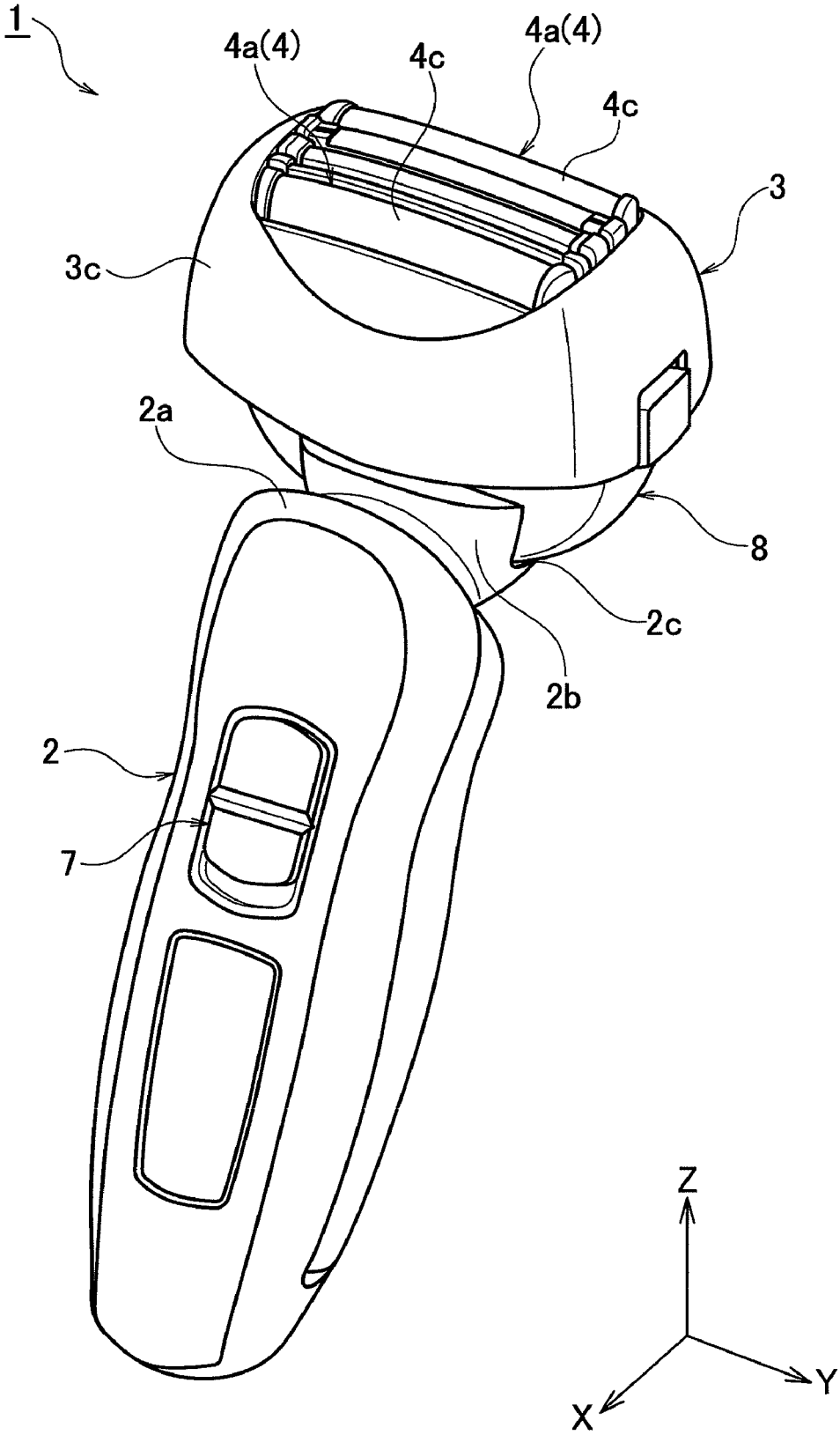
FIG. 1 is a perspective view of an electric shaver according to an embodiment of the present invention.

Hereinbelow, an embodiment of the present invention will be described in detail with reference to the drawings. Note that similar components are included in the following embodiment and its modifications, and therefore will be denoted below by common reference characters and duplicate description thereof will be omitted. In addition, in the following, an X direction, a Y direction, and a Z direction in the drawings will be referred to a front-to-rear direction, a right-to-left direction, and a top-to-bottom direction, respectively, for convenience of explanation.

As shown in FIG. 1, an electric shaver 1 according to the embodiment of the present invention includes a rod-shaped body part 2 and a head part 3 swingably attached to an end portion 2*a* on one longitudinal side (the upper side of FIG. 1) of the body part 2.

Figure 2:
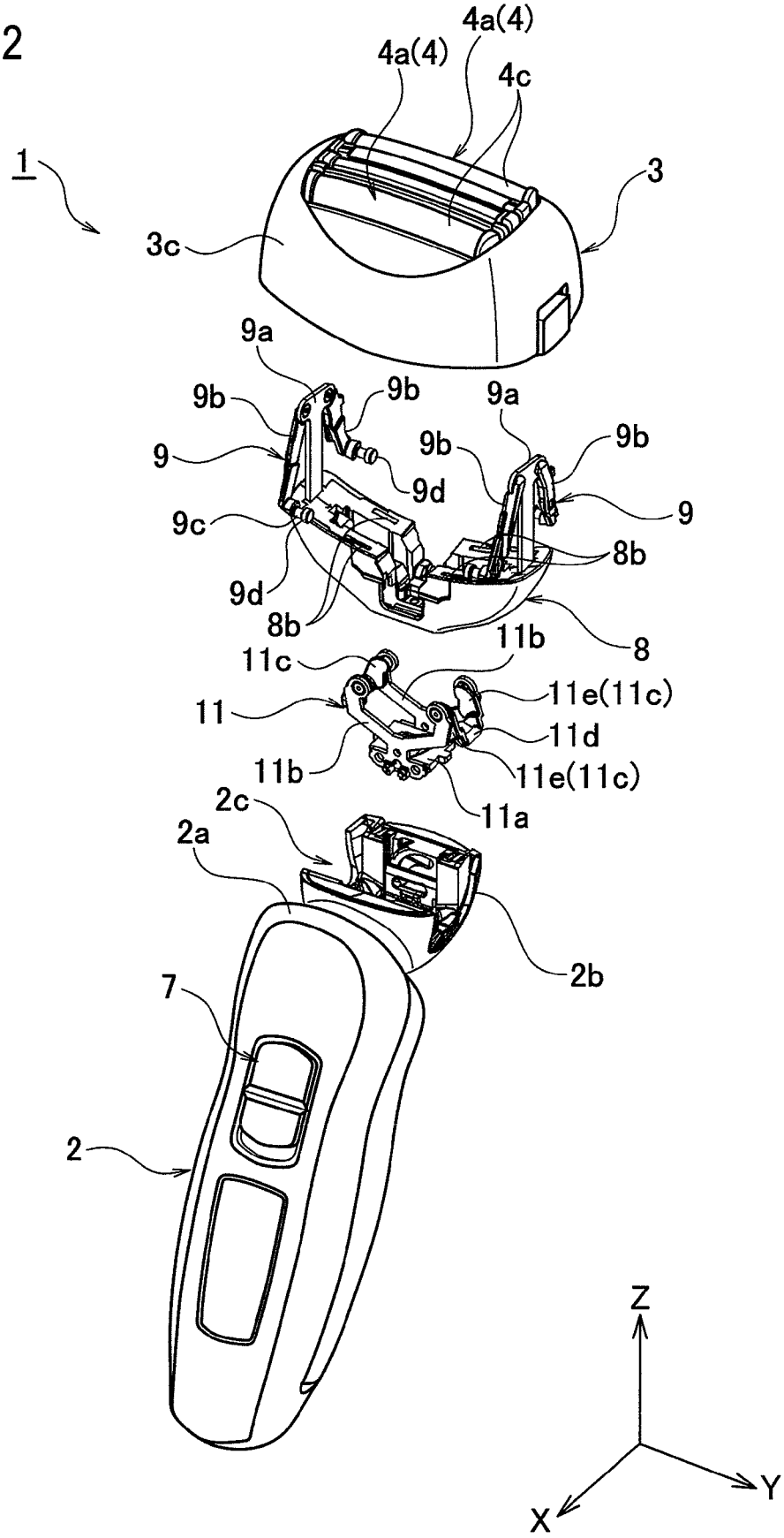
FIG. 2 is an exploded perspective view of the electric shaver according to the embodiment of the present invention.

In this embodiment, as shown in FIGS. 1 and 2, a projecting portion 2*b* which is expanded laterally (in the X direction) is formed at the end portion 2*a* on the one longitudinal side of the body part 2. The head part 3 is attached to the projecting portion 2*b*. The head part 3 projects from the body part 2 in the Z direction in FIGS. 1 and 2 (=a projecting direction, or the upper side of FIGS. 1 and 2) while being in a free state; i.e., no swinging force is acting thereon.

Figure 3:
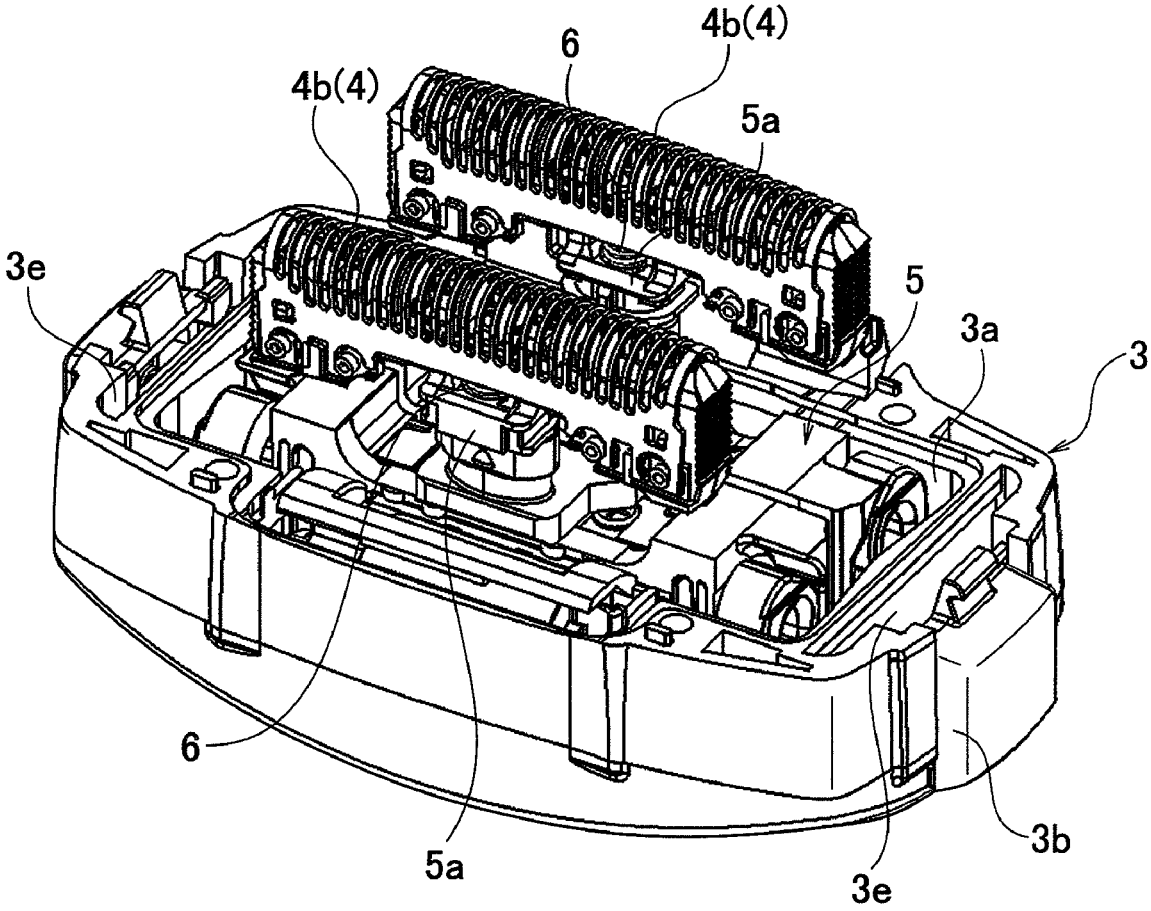
FIG. 3 is a perspective view of a head part of the electric shaver according to the embodiment of the present invention, and shows the head part with an outer case removed therefrom.
Figure 3:
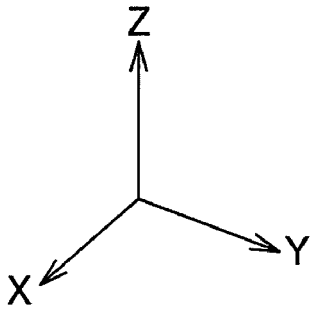

As shown in FIGS. 2 and 3, the head part 3 is provided with multiple (two in this embodiment) shaving portions 4 which are elongated in one direction (the Y direction) approximately orthogonal to the projecting direction (the Z direction) and which are parallel with each other. Each of the shaving portions 4 includes, as paired blades, an outer blade 4*a* (FIG. 2) which is exposed at the tip of the head part 3 and is formed in a mesh pattern, and an inner blade 4*b* (FIG. 3) which is configured to reciprocate in sliding contact with the inner surface of the outer blade 4*a*. The shaving portion 4 is configured so that hair let in the shaving portions 4 via openings in the mesh pattern of the outer blade 4*a* would be cut between the inner surface of the outer blade 4*a* and the outer surface of the inner blade 4*b*. The outer surfaces of the outer blades 4*a* serve as contact surfaces 4*c*. In this embodiment, each outer blade 4*a* is fixed to the head part 3, whereas each inner blade 4*b* is configured to be reciprocally driven in a longitudinal direction of its shaving portion 4 (i.e., the Y direction) by a drive mechanism 5 configured for example as a linear motor. This configuration allows a relative action by a pair of the outer blade 4*a* and the inner blade 4*b*, which in turn produces the above cutting function. Note that, in this embodiment, the two inner blades 4*b* are configured to reciprocate in opposite phases in the Y direction.

The head part 3 includes a head case 3*b* (FIG. 3) having a concave portion 3*a* in the shape of a bottomed square cylinder and an outer case 3*c* (FIG. 2) configured to cover the opening side of the head case 3*b*. The drive mechanism 5 is housed in the concave portion 3*a*. The inner blades 4*b* are attached to movable portions 5*a* of the drive mechanism 5, respectively, whereas the outer blades 4*a* are attached to the outer case 3*c*. The inner blades 4*b* are pressed against the respective outer blades 4*a* from the inside (the lower side of FIGS. 2 and 3) when the outer case 3*c* having the outer blades 4*a* attached thereto are brought to cover and be attached to the head case 3*b* having the drive mechanism 5 and the inner blades 4*b* attached thereto. Incidentally, appropriate pressing forces can be applied between the inner blades 4*b* and the outer blades 4*a* by biasing mechanisms 6, such for example as coil springs, attached to the movable portions 5*a*, respectively.

As shown in FIGS. 1 and 2, an operation part 7 is provided on a surface of the body part 2. The user's manipulation of the operation part 7 allows switching between actuation and deactuation of the drive mechanism 5. The body part 2 houses a battery as a power source of the drive mechanism 5, a converter configured to convert an AC power to a DC power, a drive circuit configured to drive the drive mechanism 5, and the like. To shave hair, such as a beard, the user activates the drive mechanism 5, by manipulating the operation part 7, to thus reciprocate the inner blades 4*b*; and moves the electric shaver 1 along a skin (shaving area) while holding the body part 2 and pressing the contact surfaces 4*c* of the outer blades 4*a* at the tip of the head part 3 against the skin.

Figure 4:
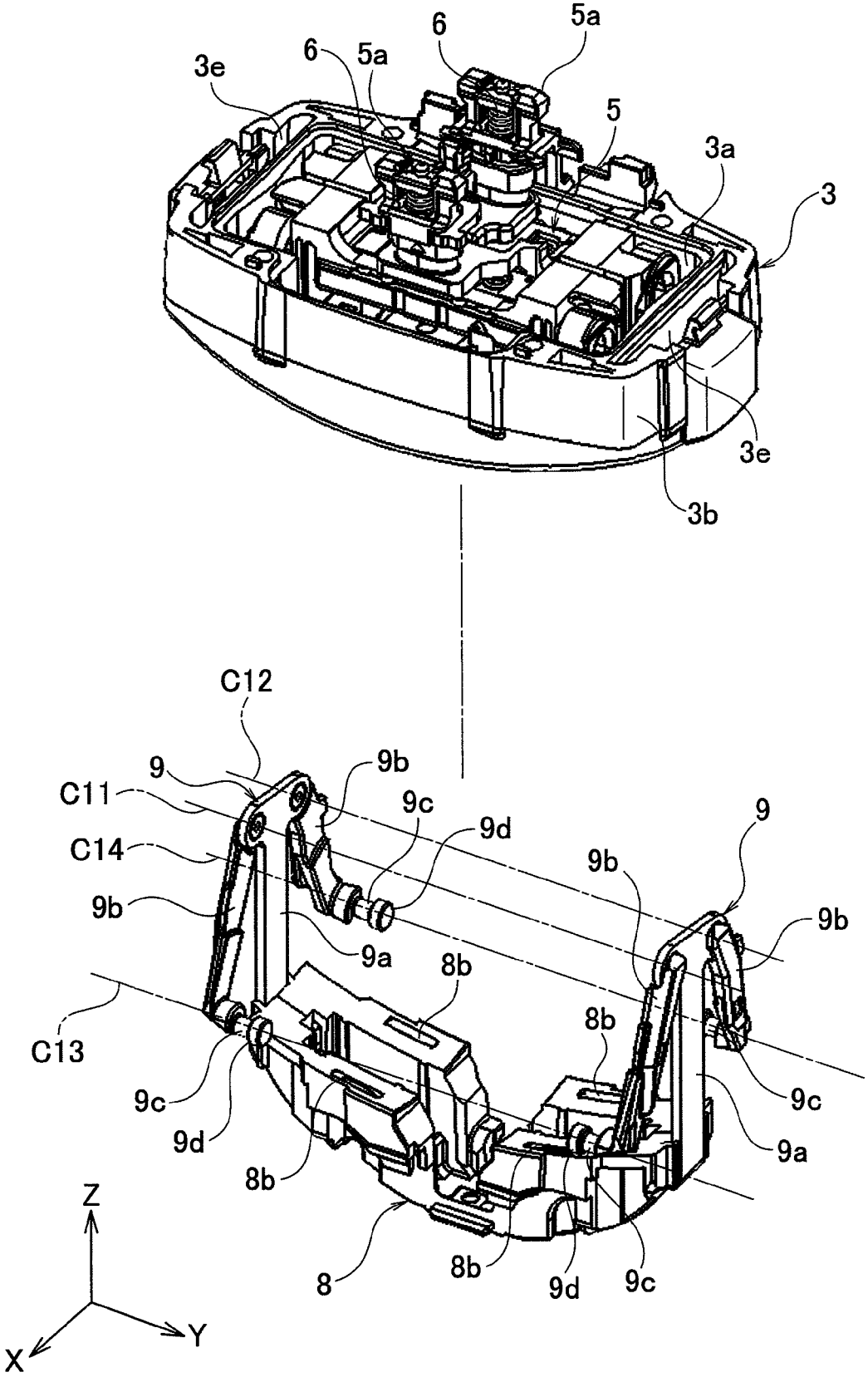
FIG. 4 is an exploded perspective view showing an interposer, first link mechanisms, and part of the head part, all of which are included in the electric shaver according to the embodiment of the present invention.

In this embodiment, as shown in FIGS. 2, 4, and so on, an interposer 8 is provided between the body part 2 and the head part 3. The interposer 8 is configured to be swingably supported by the body part 2 and also to swingably support the head part 3. Specifically, the interposer 8 supports the head part 3 swingably about a first swing axis Ay (FIG. 7, etc.) approximately parallel with the longitudinal direction of the shaving portions 4 (i.e., the Y direction). Moreover, the interposer 8 is supported by the body part 2 (FIG. 7, etc.) swingably about a second swing axis Ax which is approximately orthogonal to the projecting direction of the head part 3 (i.e., the Z direction) and also extends in a direction (the X direction) orthogonal to the first swing axis Ay.

Figure 8:
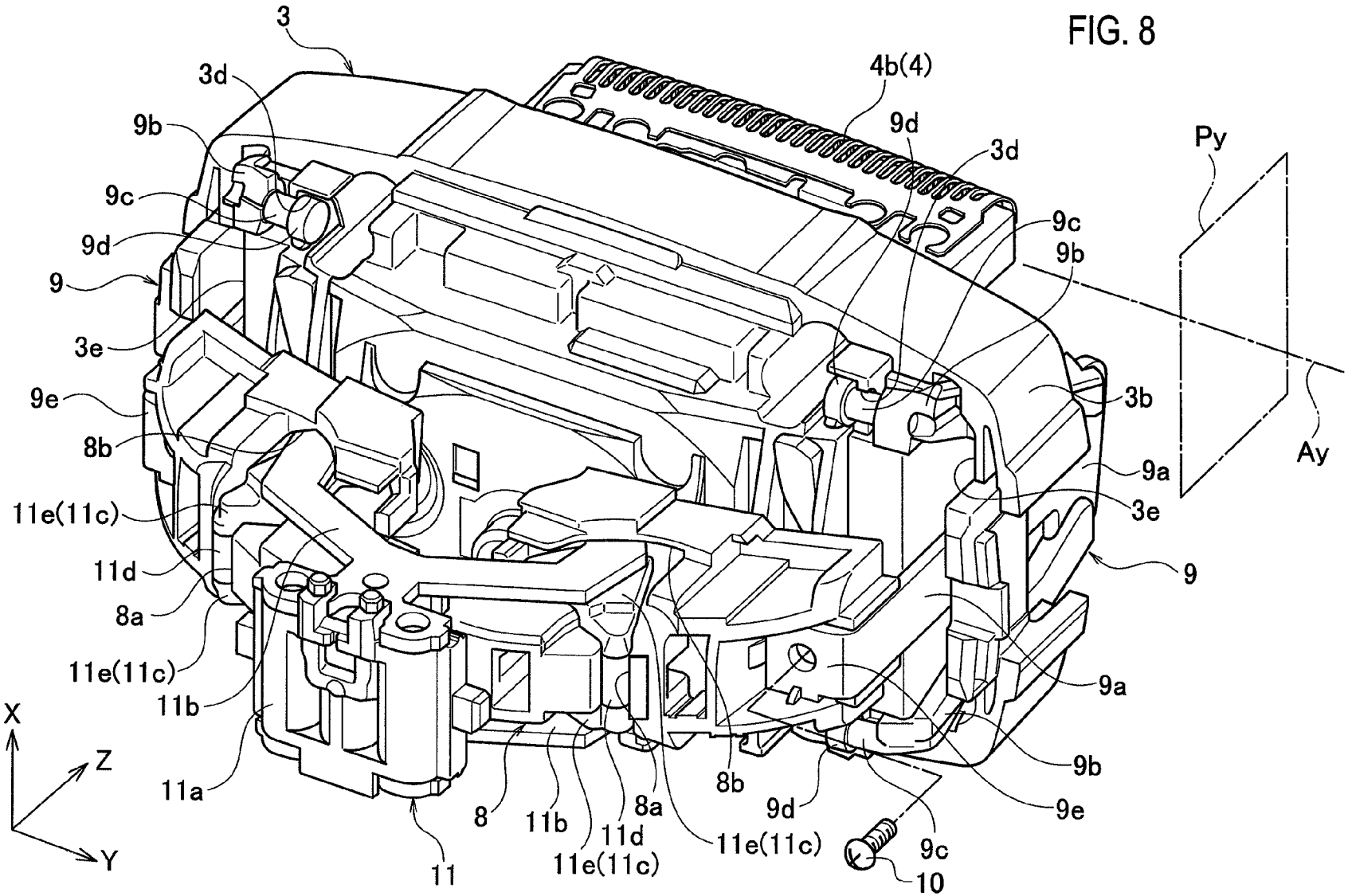
FIG. 8 is a perspective view (a view seen from a body part side in a Z direction) showing the second link mechanism, the interposer, the first link mechanisms, and part of the head part, all of which are included in the electric shaver according to the embodiment of the present invention.

The head part 3 is supported by the interposer 8 with first link mechanisms 9 therebetween. As shown in FIGS. 2, 4, and so on, there are provided two first link mechanisms 9 which are separated in the longitudinal direction of the shaving portions 4 (i.e., the Y direction). Each of the first link mechanisms 9 includes: an approximately T-shaped first support arm 9*a* which is fixed to an end portion, in the Y direction, of the interposer 8 and projects in the Z direction; and two first link arms 9*b* which are rotatably connected to one Z-direction side (a side closer to the tip of the head part 3, or the upper side of FIG. 4) of the first support arm 9*a*, and which are separated in the X direction. An approximately-cylindrical protrusion 9*c* projecting toward the center, in the Y direction, of the head part 3 is provided to the other Z-direction side (a side closer to the body part 2, or the lower side of FIG. 4) of each first link arm 9*b*. The protrusion 9*c* is provided with an enlarged diameter portion 9*d*. As shown in FIG. 8, receivers 3*d* are formed on the other Z-direction side (a near side of FIG. 8) of the head part 3. Each receiver 3*d* is in a concavoconvex shape (a stepped, semicylindrical concave portion, for example) corresponding to the protrusion 9*c* and the enlarged diameter portion 9*d*. The protrusion 9*c* and the enlarged diameter portion 9*d* as well as the receiver 3*d* are configured in such a way that the protrusion 9*c* and the enlarged diameter portion 9*d* can be fitted into the receiver 3*d* while at least one of the protrusion 9*c* and the enlarged diameter portion 9*d* or the receiver 3*d* is elastically deformed and mutually approaches each other in the Z direction. In this embodiment, the fitted state of these portions allows the protrusion 9*c* and the enlarged diameter portion 9*d* to be supported by the receiver 3*d* rotatably about the Y direction. In other words, in this embodiment, each of the first link arms 9*b* is rotatably connected to both the interposer 8 and the body part 2.

As shown in FIG. 4, the two first link mechanisms 9 have symmetrical configurations on the right and left sides. Thus, the first link arms 9*b* are disposed so that each pair of connecting axes C11 to C14 corresponding between the two right and left first link mechanisms 9 can be concentric. Here, the connecting axes C11 to C14 extend in the Y direction and are used for connection of the first link arms 9*b* to the interposer 8 or the body part 2.

Figure 6:
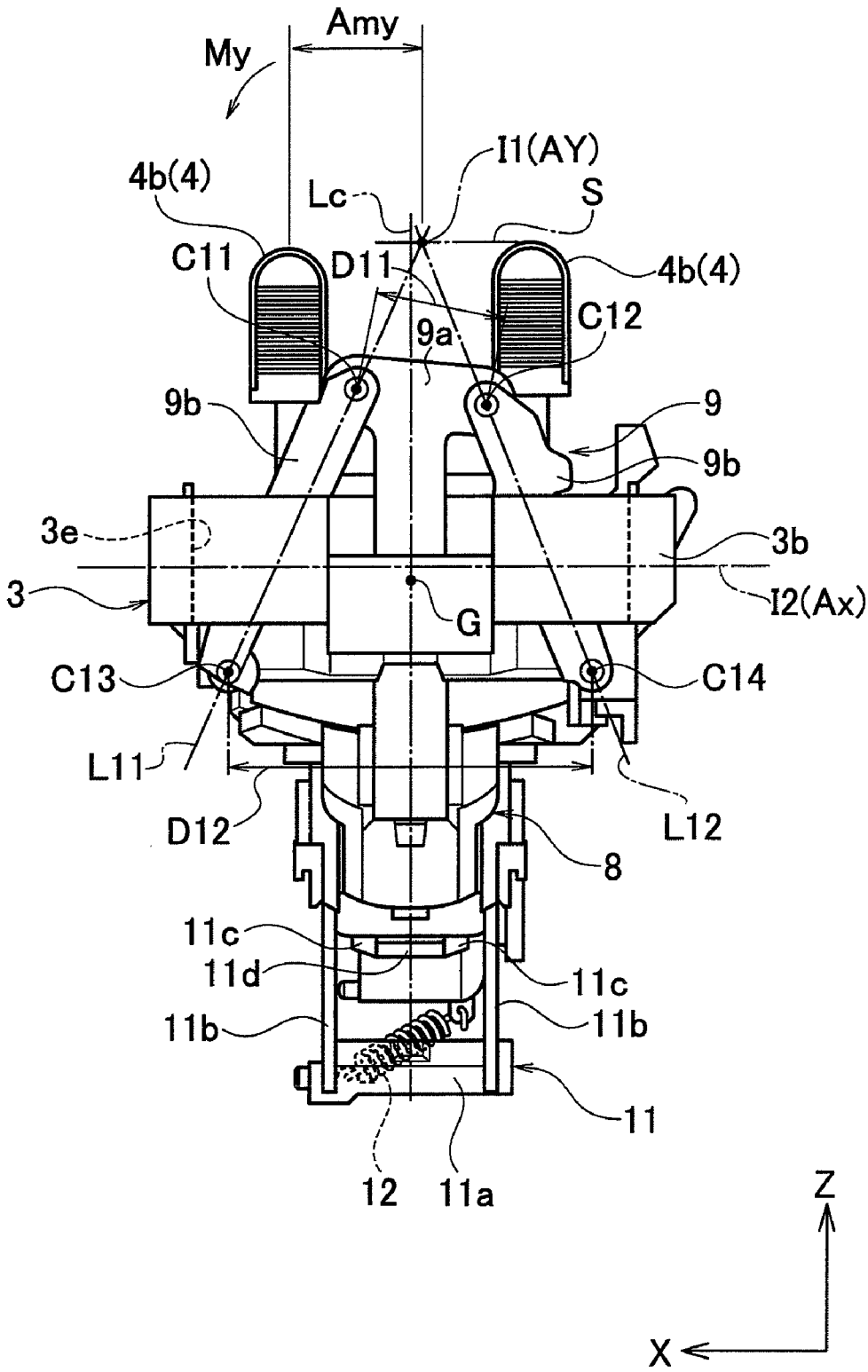
FIG. 6 is a side view (a view seen from a Y direction) showing the second link mechanism, the interposer, the first link mechanisms, and part of the head part, all of which are included in the electric shaver according to the embodiment of the present invention.

Thus, in this embodiment, as shown in FIG. 6, the first link mechanisms 9 form a planar four-link mechanism in which the head part 3 and the interposer 8 (or the first support arms 9*a* fixed thereto) are rotatably connected to the two first link arms 9*b* in four portions at the four connecting axes C11 to C14 extending in the Y direction.

As shown in FIG. 6, in this embodiment, a distance D11 between the connecting axes C11 and C12 for connection of the link arms 9*b* to the interposer 8 (the first support arm 9*a* fixed to the interposer 8 in this embodiment) is made shorter than a distance D12 between the connecting axes C13 and C14 for connection of the first link arms 9*b* to the head part 3. Further, when viewed in the Y direction (i.e., in the view of FIG. 6), each of the first link mechanisms 9 is configured so that an intersection I1 of a straight line L11 (which joins the connecting axes C11 and C13 for one of the first link arms 9*b*) with a straight line L12 (which joins the connecting axes C12 and C14 for the other first link arm 9*b*) can be located near the position of a tip portion S (indicated by a chain line in FIGS. 6 and 7), in the projecting direction (the Z direction), of the contact surface 4*c* of the outer blade 4*a* of each shaving portion 4 disposed on the side closer to the tip, in the Z direction, of the head part 3. In this configuration, the intersection I1 may be considered as the first swing axis Ay in the state shown in FIG. 6 (the free state).

In each of the first link mechanisms 9 according to this embodiment, the distance D11 is set shorter than the distance D12 as mentioned above. If they were set equal to each other, the first link mechanism would be parallelogram, which permits only parallel movement of the contact surfaces 4*c* of the head part 3 and thus makes it impossible to obtain a swing action. Meanwhile, if the distance D11 were set longer than the distance D12, the first swing axis Ay would get away from the contact surfaces 4*c*. This causes the contact surfaces 4*c* to slide on a shaving area when the head part 3 swings, which increases the swing resistance. That is to say, in this embodiment, by setting the distance D11 shorter than the distance D12, a smoother swing action about the first swing axis Ay is obtained.

Here, in this embodiment, as shown in FIG. 6, the two first link arms 9*b* are disposed asymmetrically with respect to a straight line Lc passing on the center of gravity G of the head part 3 and extending in the projecting direction of the head part 3 (the Z direction), when viewed in the longitudinal direction of the shaving portions 4 (the Y direction) (i.e., in the view of FIG. 6). Accordingly, setting of the first swing axis Ay can be achieved by shifting it from the straight line Lc in a relatively simple manner. Also, the position of the first swing axis Ay in the Z direction can be set in a relatively simple manner. Specifically, since this embodiment uses the first link mechanisms 9, the position of the first swing axis Ay can be set to any position in the XZ plane in a relatively simple manner by adjusting specifications, such as the positions of the connecting axes C11 to C14 and the shapes and lengths of the first support arms 9*a* and the first link arms 9*b*. Here, changing of a first swing axis may involve a major configuration change if a configuration as follows were employed in which an arcuate rail is provided for the interposer side (body part side), for example, while a roller is provided for the head part side to swingably support the head part side with respect to the interposer side. With this embodiment, on the other hand, the first swing axis Ay can be changed simply by changing (replacing) the first link mechanisms 9. It is therefore possible to make a configuration change during a product development stage, a change during a maintenance stage, a change due to the users' preference, and the like in a relatively simple manner at relatively low costs. Moreover, it is also possible to lower the manufacturing costs by facilitating commoditization of other components (such as the interposer 8 and the head part 3) for multiple products having different specifications.

In this embodiment, as shown in FIGS. 3, 4, 6, 8, and so on, thin slits 3*e* are formed respectively in both end portions, in the Y direction, of the head case 3*b* so as to penetrate in the Z direction and be approximately orthogonal to the Y direction. The first support arms 9*a* and the first link arms 9*b* can be inserted into the slits 3*e* from the other Z-direction side (from the lower side of FIGS. 4 and 6), thereby to penetrate the head case 3*b* in the Z direction. This configuration implements the above-described layout (see FIG. 6) in which the connecting axes C11 and C12 for connection to the interposer 8 are located closer to the one Z-direction side (the side closer to the tip of the head part 3) than the connecting axes C13 and C14 for connection to the head part 3 are to thus dispose the intersection I1 (the first swing axis Ay) near the tip portion S, in the projecting direction (the Z direction), of each contact surface 4*c*. This configuration also makes it possible to improve the assemblability of the first link mechanisms 9.

In this embodiment, as shown in FIG. 8, each of the first support arms 9*a* is provided with an attachment 9*e* having a flat portion (a rear surface of the attachment 9*e* in the view of FIG. 8) which intersects with (or, in this embodiment, is orthogonal to) an imaginary plane Py (see the XZ plane in FIG. 8) orthogonal to the first swing axis Ay. With the flat portions abutting against the interposer 8, the attachments 9*e* are fixed to the interposer 8 with screws 10. This configuration allows the portions (where the flat portions abut against the interposer 8) to receive a force caused by the swing of the head part 3 and acting on the attachment portions of the first support arms 9*a*. Consequently, misalignment of the first support arms 9*a* from the interposer 8 due to the swing is suppressed. Moreover, even if the first support arms 9*a* are fixed with the screws 10, it is possible to suppress loosening of the screws 10 due to the swing of the head part 3.

Figure 5:
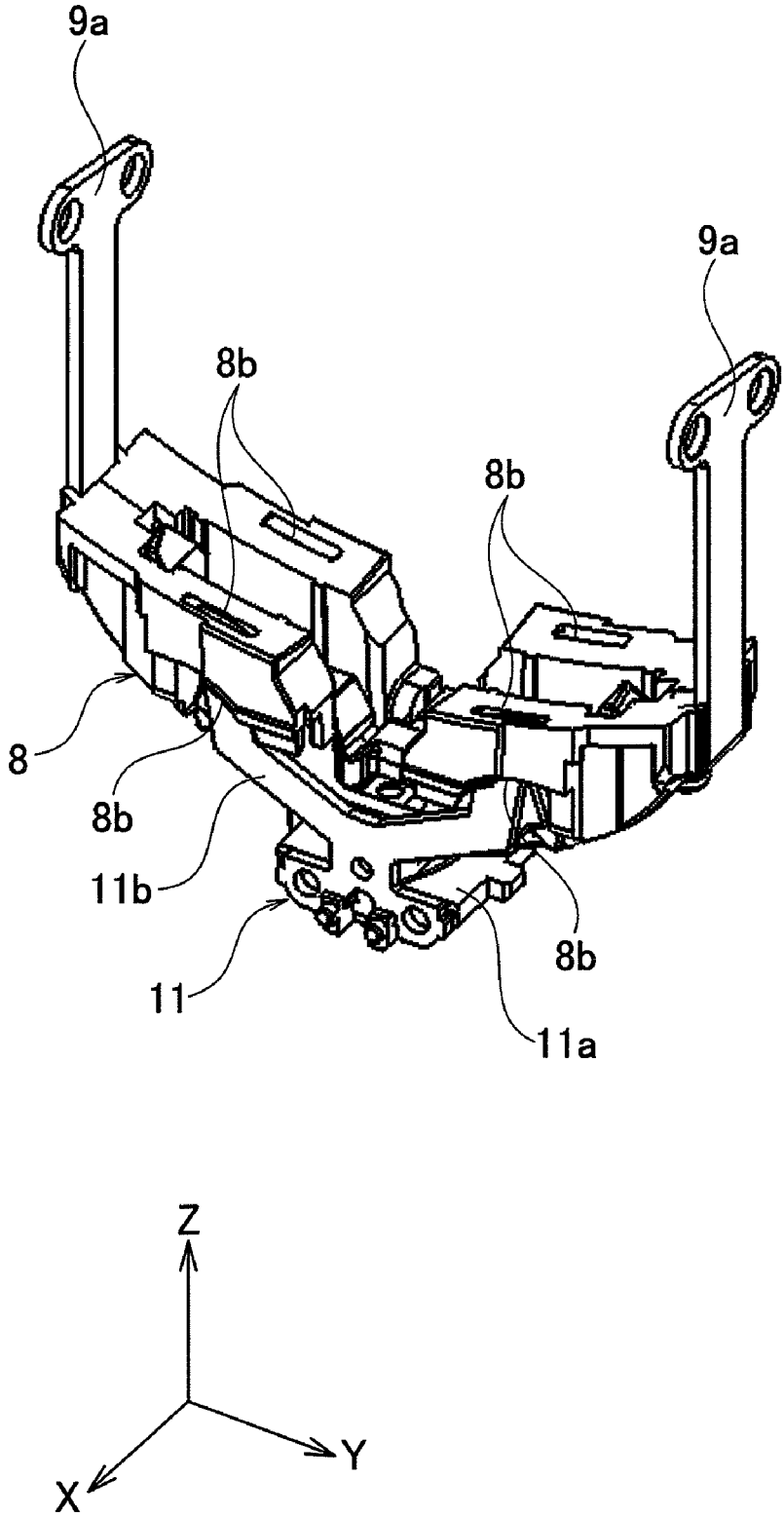
FIG. 5 is a perspective view showing a second link mechanism, the interposer, and part of the first link mechanisms, all of which are included in the electric shaver according to the embodiment of the present invention.

The interposer 8 is supported by the body part 2 with a second link mechanism 11 therebetween. As shown in FIG. 2, the second link mechanism 11 is, for example, screwed or fitted to, in other words, fixed to the projecting portion 2*b* while being housed inside a concave portion 2*c* formed in the projecting portion 2*b* of the body part 2. Moreover, as shown in FIGS. 2, 5, 8, and so on, the second link mechanism 11 includes: a base 11*a* in the shape of an approximately-rectangular flat plate; two second support arms 11*b* projecting in approximately Y-shapes toward the one Z-direction side (the side closer to the tip of the head part 3) respectively from both end portions, in the X direction, of the base 11*a*; and two second link arms 11*c* bridged between the two second support arms 11*b*. The two second link arms 11*c* are disposed away from each other in the Y direction and connected to the second support arms 11*b* respectively so as to be rotatable about connecting axes C21 and C22 extending in the X direction (FIG. 7).

The second link arms 11*c* are each formed in an approximately U-shape when viewed in the Y direction. Portions of each second link arm 11*c* on the opening side of the U shape are rotatably supported by the second support arms lib, respectively, whereas the interposer 8 is rotatably attached to a bottom portion 11*d* of the U shape. In this embodiment, the bottom portion 11*d* in an approximately cylindrical shape is bridged between a pair of side portions 11*e* of each second link arm 11*c* so as to be rotatable about the axis thereof. Also, the bottom portion 11*d* is fitted and thus attached to a receiver 8*a* formed as an approximately-cylindrical concave portion in a bottom portion of the interposer 8, by bringing the bottom portion 11*d* closer to the receiver 8*a* from the other Z-direction side (the near side of FIG. 8). In other words, in this embodiment, the central axes of the bottom portions 11*d* serve respectively as connecting axes C23 and C24 (FIG. 7) extending in the X direction.

Figure 7:
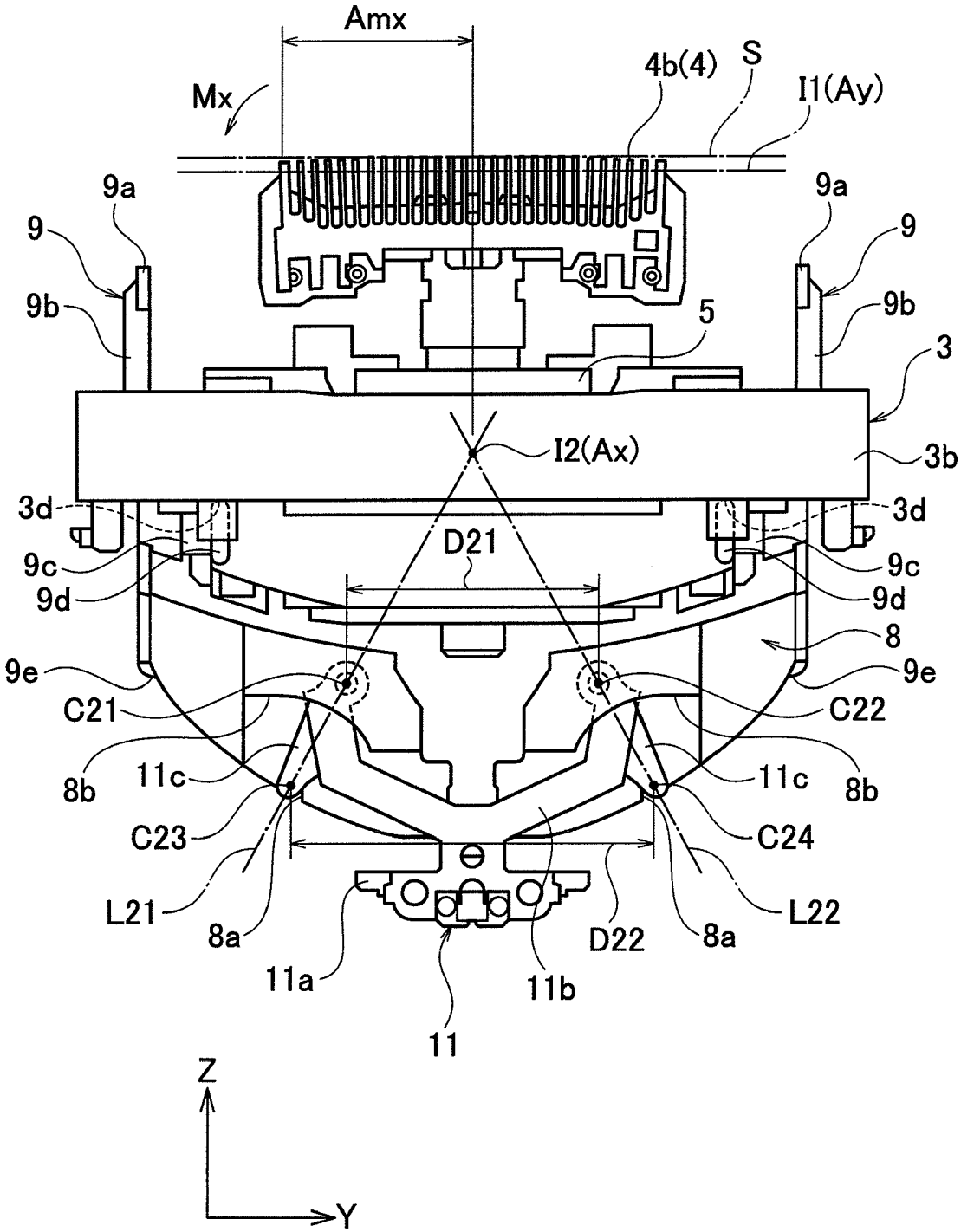
FIG. 7 is a front view (a view seen from an X direction) showing the second link mechanism, the interposer, the first link mechanisms, and part of the head part, all of which are included in the electric shaver according to the embodiment of the present invention.

Thus, in this embodiment, as shown in FIG. 7, the second link mechanism 11 forms a planar four-link mechanism in which the interposer 8 and the body part 2 (or the second support arms 11*b* fixed thereto) are rotatably connected to the two second link arms 11*c*) in four portions at the four connecting axes C21 to C24 extending in the X direction.

As shown in FIG. 7, as in the case of the first link mechanisms 9 described above, the second link mechanism 11 is also configured so that a distance D21 between the connecting axes C21 and C22 for connection of the second link arms 11*c* to the body part 2 (in this embodiment, the second support arms lib fixed to the body part 2) would be shorter than a distance D22 between the connecting axes C23 and C24 for connection of the second link arms 11*c* to the interposer 8. Further, when viewed in the X direction (i.e., in the view of FIG. 7), the second link mechanism 11 is configured so that an intersection 12 of a straight line L21 (which joins the connecting axes C21 and C23 for one of the second link arms 11*c*) with a straight line L22 (which joins the connecting axes C22 and C24 for the other second link arm 11*c*) can be located farther away from the position of the tip portion S, in the projecting direction (the Z direction), of the contact surface 4*c* of the outer blade 4*a* of each shaving portion 4, than the intersection I1 for the first link arms 9*b* is. In this configuration, the intersection I2 may be considered as the second swing axis Ax in the state shown in FIG. 7 (the free state).

In other words, in this embodiment, the second swing axis Ax (the intersection 12) is located away from the tip portion S, in the projecting direction (the Z direction), of the contact surface 4*c* of each shaving portion 4, the contact surface 4*c* being to be brought into contact with a shaving area. Thus, swinging the head part 3 about the second swing axis Ax causes the contact surfaces 4*c* to move (slide) along the shaving area, hence generating swing resistance.

Here, in the electric shaver 1 having the shaving portions 4 elongated in the Y direction as described in this embodiment, a moment arm Amx (FIG. 7) of the head part 3 swinging about the second swing axis Ax is longer than a moment arm Amy (FIG. 6) of the head part 3 swinging about the first swing axis Ay. Thus, a swing torque (turning moment) Mx (FIG. 7) about the second swing axis Ax is likely to be larger than a swing torque (turning moment) My (FIG. 6) about the first swing axis Ay. This creates a situation where it is easier for the head part 3 to swing about the second swing axis Ax but difficult to swing about the first swing axis Ay, if no countermeasures are taken. This might lower the following performance of the head part 3 exerted during swing on an uneven shaving area when the head part 3 is moved along the shaving area.

Meanwhile, in this embodiment, as described above, the second swing axis Ax (the intersection 12) is located farther away from the contact surface 4*c* of each shaving portion 4, than the first swing axis Ay (the intersection I1) is, the contact surface 4*c* being to be brought into contact with the shaving area. Thus, sliding between the contact surfaces 4*c* and the shaving area due to swinging of the head part 3 increases the swing (slide) resistance of the head part 3 in swing about the second swing axis Ax, thereby preventing the head part 3 from swinging easily only about the second swing axis Ax. Consequently, an improved following performance of the head part 3 on the shaving area can be exerted.

Moreover, in this embodiment, as shown in FIG. 6, a coil spring 12 is provided between the body part 2 (or, in this embodiment, the base 11*a*) and the interposer 8, as a second biasing mechanism configured to apply a reactive force against the swing of the head part 3 with respect to the body part 2 (swing of the interposer 8 with respect to the body part 2). The coil spring 12 is an elastic member bridged from one side to the other side in the direction of the second swing axis Ax. This coil spring 12 makes it possible to secure a necessary reactive force against the swing about the second swing axis Ax, and thus to further prevent the head part 3 from swinging easily only about the second swing axis Ax. In addition, the disposition of the coil spring 12 in the direction of the second swing axis Ax helps to secure a sufficient length of the coil spring 12, which in turn allows a high flexibility in setting the level of the reactive force against swing.

In this embodiment, the coil spring 12 as the second biasing mechanism is attached between the base 11*a* and the interposer 8. It is therefore possible to obtain the state where the second biasing mechanism is interposed between the body part 2 and the interposer 8 by attaching the coil spring 12 at the time of assembling the second link mechanism 11 and the interposer 8 together, and then by fixing the assembly (of the base 11*a* of the second link mechanism 11) to the body part 2. Such a configuration can reduce the amount of work required for the attachment, as compared with the case of directly installing the second biasing mechanism between the body part 2 and the interposer 8.

In this embodiment, as shown in FIGS. 2, 4, 5, 7, 8, and so on, slits 8*b* are formed in the interposer 8 also as in the case of the above-described first link mechanisms and head case 3*b*.

Into the slits 8*b*, the second support arms 11*b* and the second link arms 11*c* are inserted. The slits 8*b* are configured in such a way to allow the second support arms 11*b* and the second link arms 11*c* to be inserted therethrough from the other Z-direction side (from the lower side of FIGS. 4, 5, and 7) and thereby to penetrate the interposer 8 in the Z direction. This configuration implements the above-described layout (FIG. 6) in which the connecting axes C11 and C12 for connection to the interposer 8 are located closer to the one Z-direction side (the side closer to the tip portion of the head part 3) than the connecting axes C13 and C14 for connection to the head part 3 are to thus dispose the intersection I1 (the first swing axis Ay) near the contact surfaces 4*c*. The configuration also makes it possible to improve the assemblability of the first link mechanisms 9.

As has been described above, in this embodiment, the two pairs of the first link arms 9*b* are disposed asymmetrically with respect to the straight line Lc passing on the center of gravity G of the head part 3 and extending in parallel with the projecting direction of the head part 3 (the Z direction), when viewed in the longitudinal direction of the shaving portions 4 (the Y direction) (i.e., in the view of FIG. 6). In other words, with such a relatively simple configuration only requiring the asymmetrical disposition of the first link arms 9*b*, it is possible to set the position of the first swing axis Ay to a more appropriate position in the projecting direction of the head part 3 (the Z direction) and also in the direction (the X direction) orthogonal to the longitudinal direction of the shaving portions 4 (the Y direction) (i.e., the first swing axis Ay is set at a position on the XZ plane), in a relatively simple manner. This makes it easier to set a more appropriate moment arm Amy about the first swing axis Ay for an input from a shaving area to the head part 3 (the contact surfaces 4*c* thereof), and thus makes it easier to set more appropriate swing load torque about the first swing axis Ay. Consequently, an improved following performance of the head part 3 on the shaving area can be exerted more easily.

(First Modification)

Figure 9:
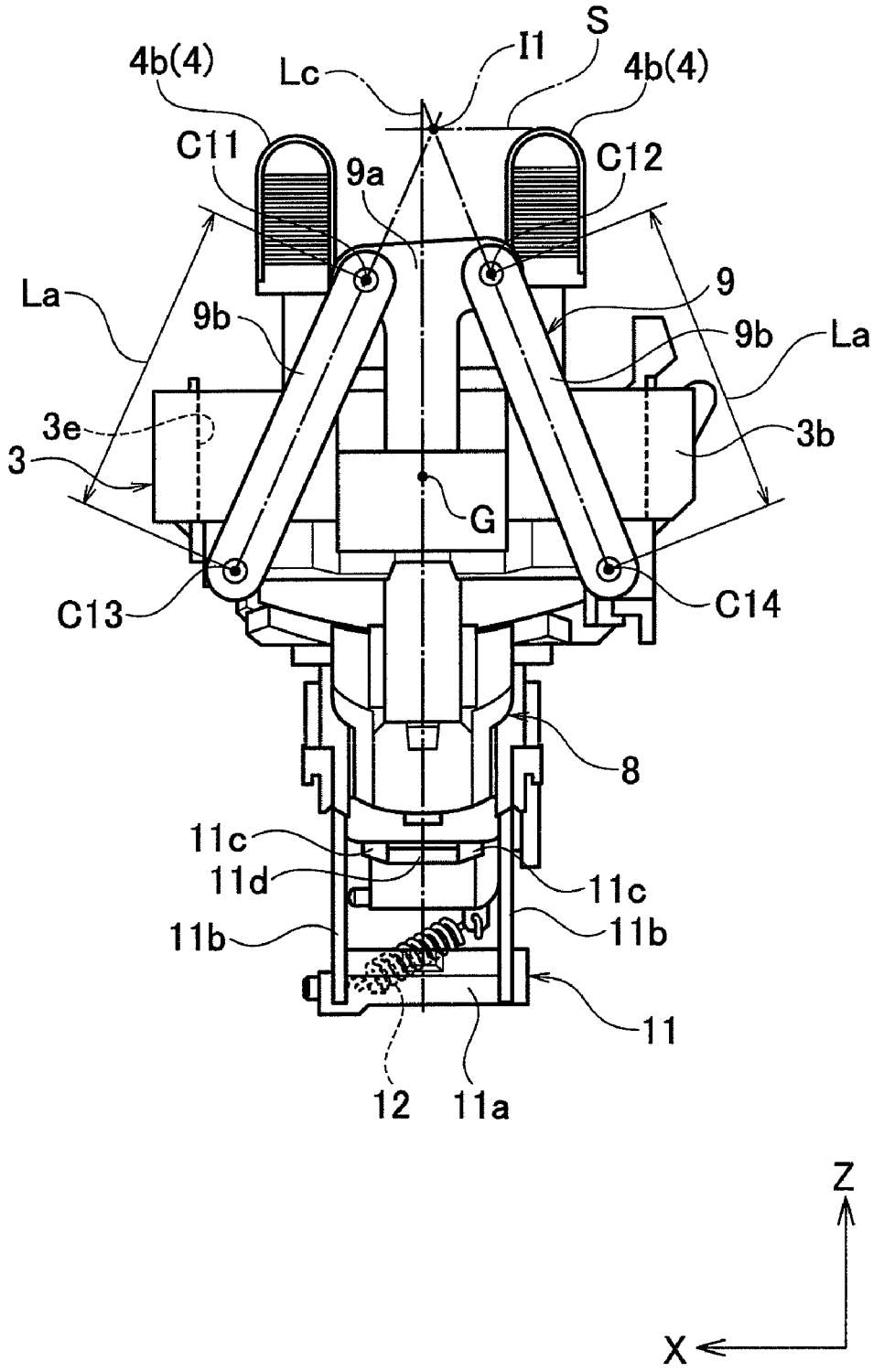
FIG. 9 is a side view (a view seen from the Y direction) showing the second link mechanism, the interposer, the first link mechanisms, and part of the head part, all of which are included in an electric shaver according to a first modification of the embodiment of the present invention.

As shown in FIG. 9, in a first modification of the above embodiment as well, the two pairs of the first link arms 9*b* are disposed asymmetrically with respect to the straight line Lc. In the first modification, however, the connecting axes C11 and C12 for connection of the two pairs of the first link arms 9*b* to the interposer 8 are located asymmetrically with respect to the straight line Lc, when viewed in the Y direction. For example, as shown in FIG. 9, the positions of the connecting axes C11 and C12 in the Z direction may be slightly shifted. Such a configuration can make the swing torque based on an input to the connecting axis C11 (swing torque in a counterclockwise direction in FIG. 9) differ from the swing torque based on an input to the connecting axis C12 (swing torque in a clockwise direction in FIG. 9). Consequently, the swing torque can be produced differently depending on the swing direction.

In addition, in the first modification, the two pairs of the first link arms 9*b* are identical in shape and also in length (length between the connecting axes) La. This facilitates commoditization of components and thus enables a reduction in manufacturing costs.

(Second Modification)

Figure 10:
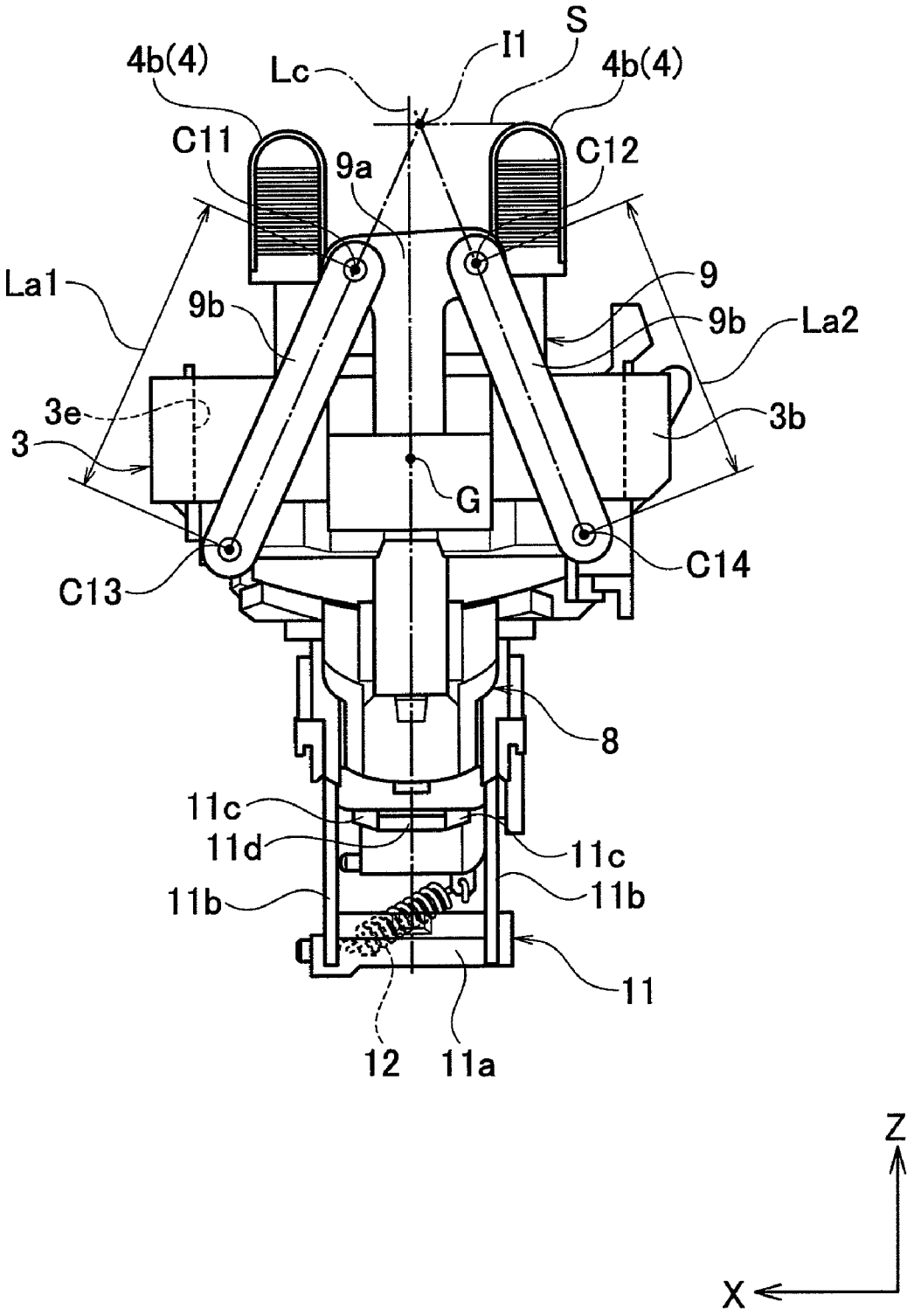
FIG. 10 is a side view (a view seen from the Y direction) showing the second link mechanism, the interposer, the first link mechanisms, and part of the head part, all of which are included in an electric shaver according to a second modification of the embodiment of the present invention.

As shown in FIG. 10, in a second modification of the above embodiment as well, the two pairs of the first link arms 9*b* are disposed asymmetrically with respect to the straight line Lc. In the second modification, however, the connecting axes C13 and C14 for connection of the two pairs of the first link arms 9*b* to the head part 3 are located asymmetrically with respect to the straight line Lc, when viewed in the Y direction. For example, as shown in FIG. 10, the positions of the connecting axes C13 and C14 in the Z direction may be shifted. Such a configuration can make the swing torque based on an input to the connecting axis C13 (swing torque in a counterclockwise direction in FIG. 10) differ from the swing torque based on an input to the connecting axis C14 (swing torque in a clockwise direction in FIG. 10). Consequently, the swing torque can be produced differently depending on the swing direction.

In addition, in the second modification, lengths La1 and La2 of the two pairs of the first link arms 9*b* (the lengths between the connecting axes) are made different from each other (La1>La2 in this example). This allows a high flexibility in setting the moment arm as well as the swing torque, as compared to the case of equally setting the lengths of the two pairs of the first link arms 9*b*.

One embodiment of the present invention has been described above, but the present invention is not limited to the above embodiment, and various modifications are possible. For example, it is possible to employ a configuration in which the electric shaver 1 does not include the interposer 8 and the second link mechanism 11, and the head part 3 is swingably supported by the body part 2 with the first link mechanisms 9 therebetween. In this case, the body part 2 serves as the support base. It is also possible to employ a configuration in which, for example, the electric shaver 1 does not include the second link mechanism 11, and the head part 3 is swingably supported by the body part 2 with the first link mechanisms 9 and the interposer 8 therebetween. In this case, the interposer 8 serves as the support base.

What is claimed is:

1. An electric shaver comprising:

a rod-shaped body part;

a head part projecting from one end portion, in a longitudinal direction, of the body part and swingably attached to the body part with a support base between the body part and the head part, the head part including a shaving portion and a drive mechanism, the shaving portion formed to be elongated in a direction orthogonal to a projecting direction of the head part and having paired blades configured to operate relative to each other, the drive mechanism configured to drive at least one of the paired blades; and a link mechanism including two link arms each connected to the support base and the head part respectively at connecting axes parallel to a longitudinal direction of the shaving portion, the link mechanism configured to support the head part on the support base swingably, wherein the two link arms are disposed asymmetrically with respect to a straight line passing on a center of gravity of the head part and extending parallel with the projecting direction of the head part, when viewed in the longitudinal direction of the shaving portion, wherein the support base is formed separately from the body part, and wherein the electric shaver further comprises another link mechanism configured to support the support base on the body part swingably about an axis orthogonal to the projecting direction of the head part and the connecting axes.

2. The electric shaver according to claim 1, wherein lengths of the two link arms are different from each other.

3. The electric shaver according to claim 2, wherein the connecting axes for connection of the two link arms to the support base are located asymmetrically with respect to the straight line, when viewed in the longitudinal direction of the shaving portion.

4. The electric shaver according to claim 3, wherein the connecting axes for connection of the two link arms to the head part are located asymmetrically with respect to the straight line, when viewed in the longitudinal direction of the shaving portion.

5. The electric shaver according to claim 3, wherein the connecting axes for connection of the two link arms to the support base are displaced from each other in a direction of the straight line.

6. The electric shaver according to claim 4, wherein the connecting axes for connection of the two link arms to the head part are displaced from each other in a direction of the straight line.

7. The electric shaver according to claim 1, wherein lengths of the two link arms are identical to each other.

* * * * *